US008371658B2

(12) United States Patent
Breedlove et al.

(10) Patent No.: US 8,371,658 B2
(45) Date of Patent: Feb. 12, 2013

(54) APPARATUS AND METHOD FOR SUPPORTING A MINE RIB

(75) Inventors: John J. Breedlove, Cedar Bluff, VA (US); Erik Denver, Keen Mountain, VA (US); Herbert B. Stiltner, Abingdon, VA (US)

(73) Assignee: Heintzmann Corporation, Cedar Bluff, VA (US)

( * ) Notice: Subject to any disclaimer, the term of this patent is extended or adjusted under 35 U.S.C. 154(b) by 275 days.

(21) Appl. No.: 12/800,190

(22) Filed: May 10, 2010

(65) Prior Publication Data

US 2011/0052334 A1 Mar. 3, 2011

Related U.S. Application Data

(60) Provisional application No. 61/275,596, filed on Sep. 1, 2009.

(51) Int. Cl.
*E21D 15/14* (2006.01)

(52) U.S. Cl. ..... 299/11; 405/288; 405/294; 405/272; 405/290

(58) Field of Classification Search ..... 405/288, 405/290, 294; 299/11; 52/127.2; 248/200.1
See application file for complete search history.

(56) References Cited

U.S. PATENT DOCUMENTS

| | | | | |
|---|---|---|---|---|
| 3,972,272 | A * | 8/1976 | Bagby | 454/169 |
| 4,091,628 | A | 5/1978 | Kelley | |
| 5,709,054 | A * | 1/1998 | McGillivray | 52/167.1 |
| 7,490,440 | B2 | 2/2009 | Batty | |
| 2005/0257448 | A1 * | 11/2005 | Batty | 52/127.2 |
| 2006/0179728 | A1 * | 8/2006 | Lang | 52/127.2 |

* cited by examiner

*Primary Examiner* — John Kreck
*Assistant Examiner* — Benjamin Fiorello
(74) *Attorney, Agent, or Firm* — Carothers and Carothers

(57) ABSTRACT

A mine rib support for bracing a vertical mine rib disposed between a mine floor and a mine roof. The support includes an elongated upright and continuous telescopically expandable support having a preset curvature. The member is longitudinally expanded for engaging the mine floor and the mine roof under compression with the curvature facing towards the mine rib. A support plate is laterally extended from the support member into compression engagement with the mine rib, thereby prestressing the support for support of the mine rib.

8 Claims, 9 Drawing Sheets

APPARATUS AND METHOD FOR SUPPORTING A MINE RIB

CROSS REFERENCE

This application claims the benefit of U.S. Provisional Application No. 61/275,596, filed Sep. 1, 2009, and entitled MINE RIB SUPPORT, the content of which is incorporated herein in its entirety.

FIELD OF THE INVENTION

The present invention relates to an apparatus and method for supporting a mine rib (wall) disposed between a mine floor and a mine roof.

BACKGROUND OF THE INVENTION

As mining conditions continue to deteriorate due to depletion of easily accessible reserves, lateral pressure on mine ribs is becoming the rule, rather than the exception. In order to protect miners from rib rolls and rib burst conditions, it is an object of the present invention to provide a yielding positive anchoring rib support which allows for increasing resistance as rib convergence progresses.

Currently, the two major rib support methods being employed are ordinary timber posts with boards set on the in by side near the rib. The second method of rib support is installing a resin anchor bolt in the rib. The negative points with timber supports are the posts dislodge easily when horizontal load is applied due to the fact that they are anchored only by wooden wedges, and the transport of the timber to the installation site requires a machine due to the significant weight of the timber posts. The installation of anchor bolts in the rib requires a drilling machine and the drilling process increases the instability of the rib.

Another object of the present invention is to provide the miner with flexibility in regard to the installation process wherein the support is lightweight enough to be carried by one person and requires no special tools or equipment for installation.

The mine rib support device disclosed in U.S. Pat. No. 7,490,440, discloses a mine rib support which does alleviate some of the problems incurred with the prior art methods, however, this prior art support requires inclusion of an expensive jacking mechanism being included as an integral part of each support device. The upper and lower members of the support of this prior art reference are separated by the jacking mechanism which further decreases the amount of horizontal resistance that the support can provide. It is another object of the present invention to also eliminate these disadvantages.

SUMMARY OF THE INVENTION

The present invention provides an apparatus and method for bracing a mine rib which is disposed between a mine floor and a mine roof wherein a curved and continuous telescopically expandable elongate support member is provided and positioned in an upright manner adjacent to the mine rib to be braced or supported. The support member is telescopically expanded to engage the mine floor and the mine roof under compression adjacent the mine rib with the curvature of the support member protruding towards the mine rib to be supported. A support plate which extends laterally from the support member is then laterally extended into compression engagement with the mine rib, thereby prestressing the support member for providing yielding positive support of the mine rib.

The preset curvature of the continuous support member may be provided, at least in part, by a hinged bent knee positioned intermediate the opposite ends of the support member.

Transverse end plates are secured to opposite ends of the support member for respective engagement in turn with the mine floor and the mine roof. These plates include outwardly hinged plate portions secured to the opposite ends of the support member whereby the hinged plates are biased for gouging into the mine floor and the mine roof surfaces when the support member is placed under prestress, or placed in a prestressed condition. This ensures that the support member cannot slip when prestress conditions are applied to the support from lateral engagement under compression with the mine rib.

The support member may include two adjacent parallel upright continuous and telescopically expandable members, each having the preset curvature, and secured together in spaced relationship to thereby act in tandem. Also, two or more of the rib engagement plates may be provided along the rib support member for lateral extension and engagement of the mine rib under compression.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present invention wherein:

DETAILED DESCRIPTION OF THE DRAWINGS

Figures 1, 1A, 1B:
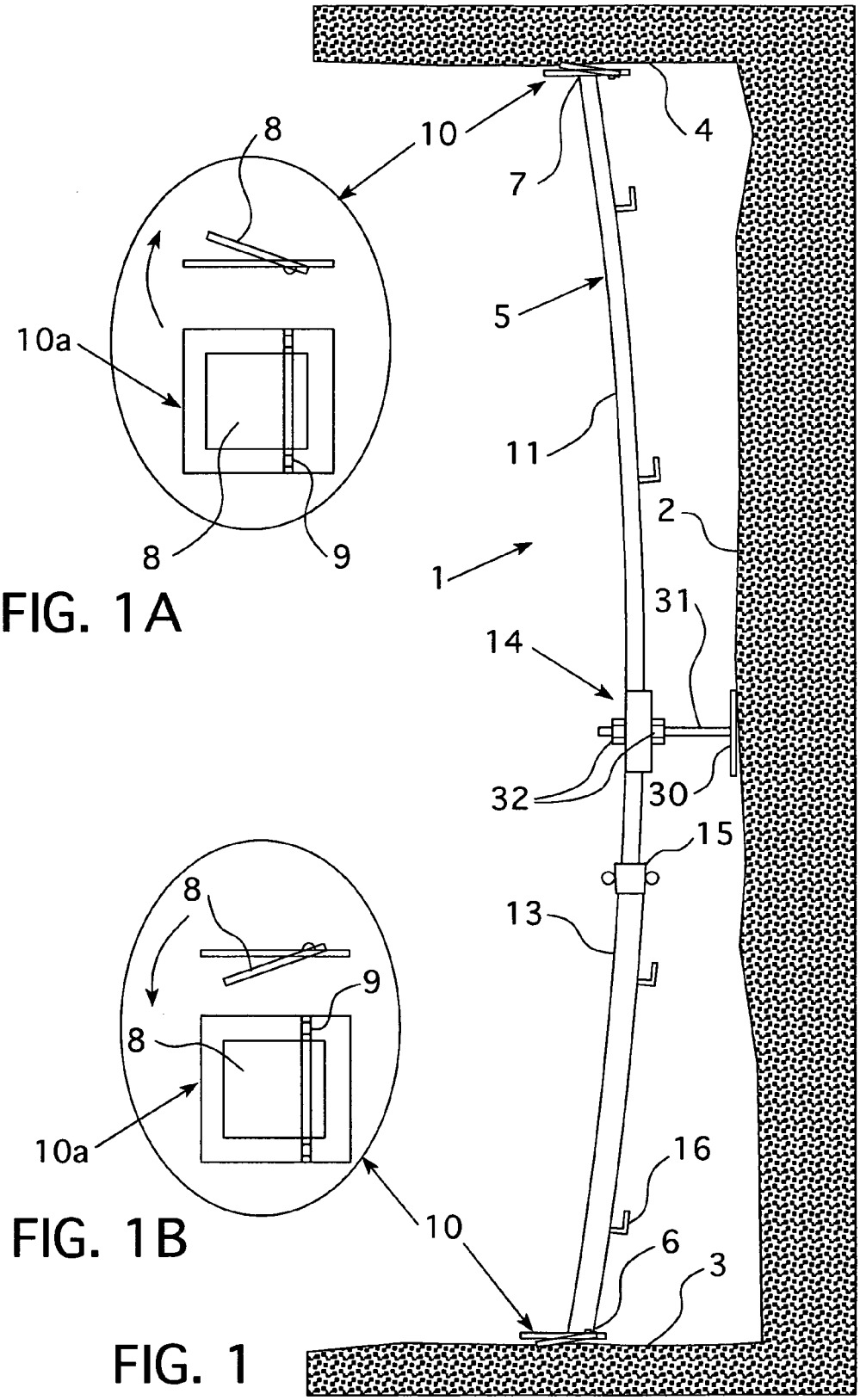
FIG. 1 is a view in side elevation of one embodiment of the mine rib support of the present invention, in a prestressed condition with the support member shown in engagement with the mine rib to be supported.
FIGS. 1A and 1B are enlarged views respectively of the mine floor and mine roof support end plate illustrating the plates in side and plan views.

Referring first to the embodiment illustrated in FIGS. 1, 1A, 1B and 2, the mine rib support of the present invention is provided for bracing the substantially vertical mine rib 2 disposed between mine floor 3 and mine roof 4.

The mine rib support 1 is comprised of an elongate upright, continuous and telescopically expandable support member 5 having a preset curvature as illustrated. Support member 5 is continuous in structure from the mine roof 4 to the mine floor 3 and is constructed of tubular steel with a top member 11 telescopically received downwardly into bottom member 13. Support member 5 is longitudinally expandable for engaging the mine floor 3 and the mine roof 4 under compression with the curvature thereof protruding towards the mine rib 2 as illustrated.

The support member 5 is longitudinally and telescopically expanded by hand, or with the assistance of a tool, so that the opposite ends 6 and 7 thereof are in engagement respectively with mine floor 3 and mine roof 4 through transverse foot and head end plates 10. The plate portions 8 of end plates 10 are secured or welded to opposite ends 6 and 7 of support member 5 for respective engagement with the mine floor 3 and the mine roof 4. Outwardly hinged plate portions 8 which are hinged at 9 in relation to the outer base plate portions 10*a*.

One support member 5 has been fully longitudinally and telescopically expanded as illustrated in FIG. 1. The two telescopically received members 11 and 13 are locked with clamp 15. This combination provides a means for longitudinally expanding and locking support member 5 into end engagement with the mine floor 3 and the roof 4. Other arrangements are possible.

Laterally extending mine rib engagement member 14 is laterally extended to contact mine rib 2. Member 14 includes rib engagement plate 30 which is laterally extended from support member 5 to engage the surface of mine rib 2 under compression on all-thread shaft 31 until the sport member 5 is placed under a sufficient prestressed condition to provide adequate yieldable support for mine rib 2. All-thread shaft 31 is then locked into position by the use of lock nuts 32. The opposite ends 6 and 7 of support member 5 are secured to the hinged plate portions 8 respectively of the transverse end plates 10 whereby the hinged plate portions 8 are outwardly biased for gouging into the surfaces of the mine floor 3 and mine roof 4 respectively when the support member 5 is placed under prestress as illustrated in the figures. For added security, wedges may be driven between hinged plate portions 8 and base plate portions 10*a*.

The hook members 16 provided on the in by side of support member 5 are provided to support boards between adjacently positioned support members 5 to provide a temporary wall surface if desired.

Figure 2:
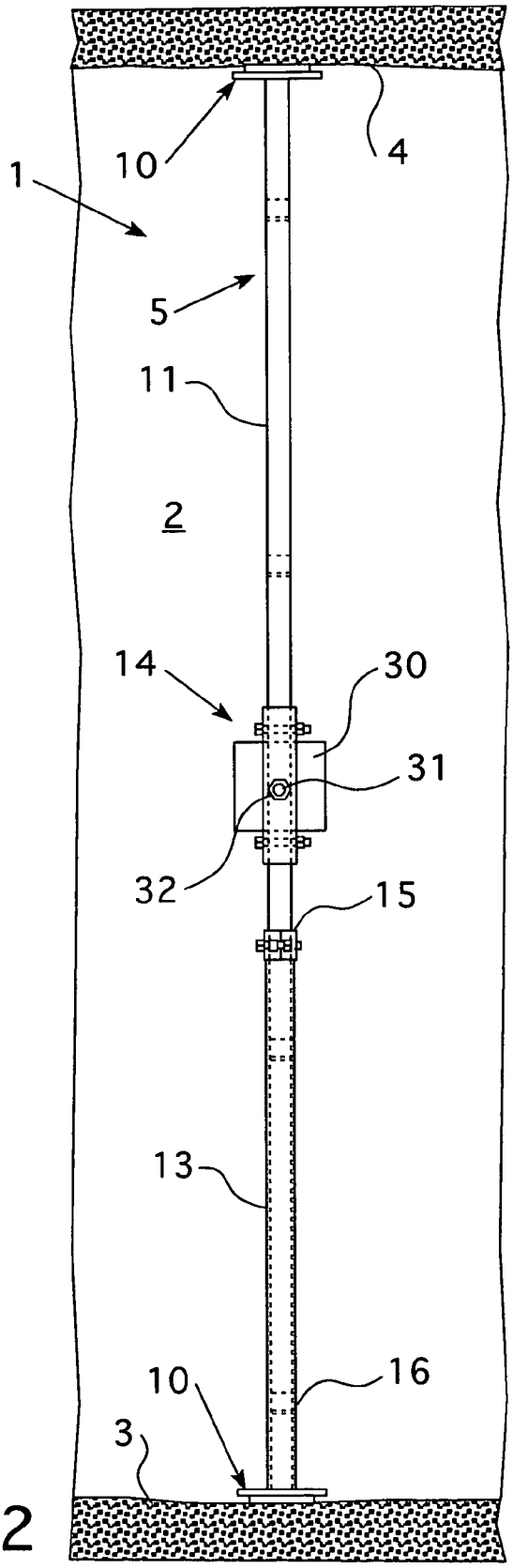
FIG. 2 is a left side view of the support member illustrated in FIG. 1.
Figure 3:
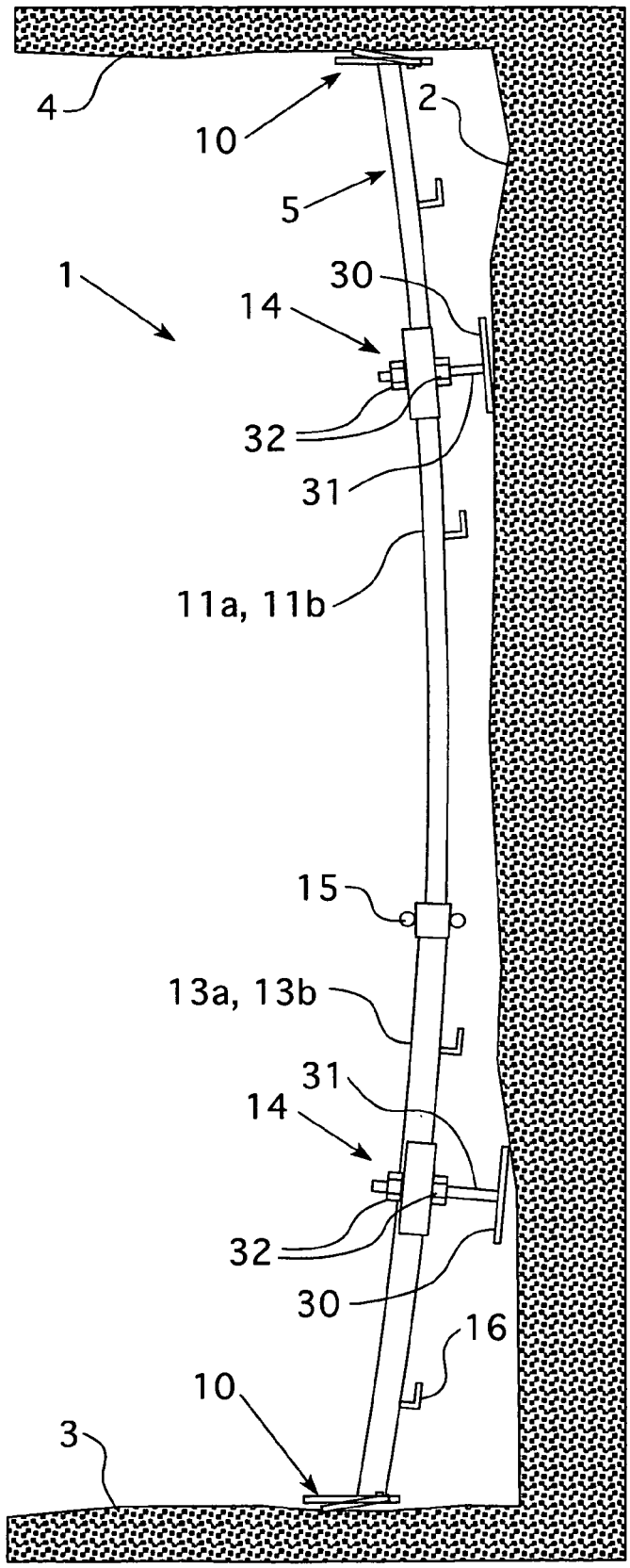
FIG. 3 is a view in side elevation of another embodiment of the support member of the present invention incorporating two adjacent parallel support members with two (upper and lower) rib engagement plates secured to the support member for adjustable lateral extension to adjustably engage the mine rib under compression in order to prestress the support member.
Figure 4:
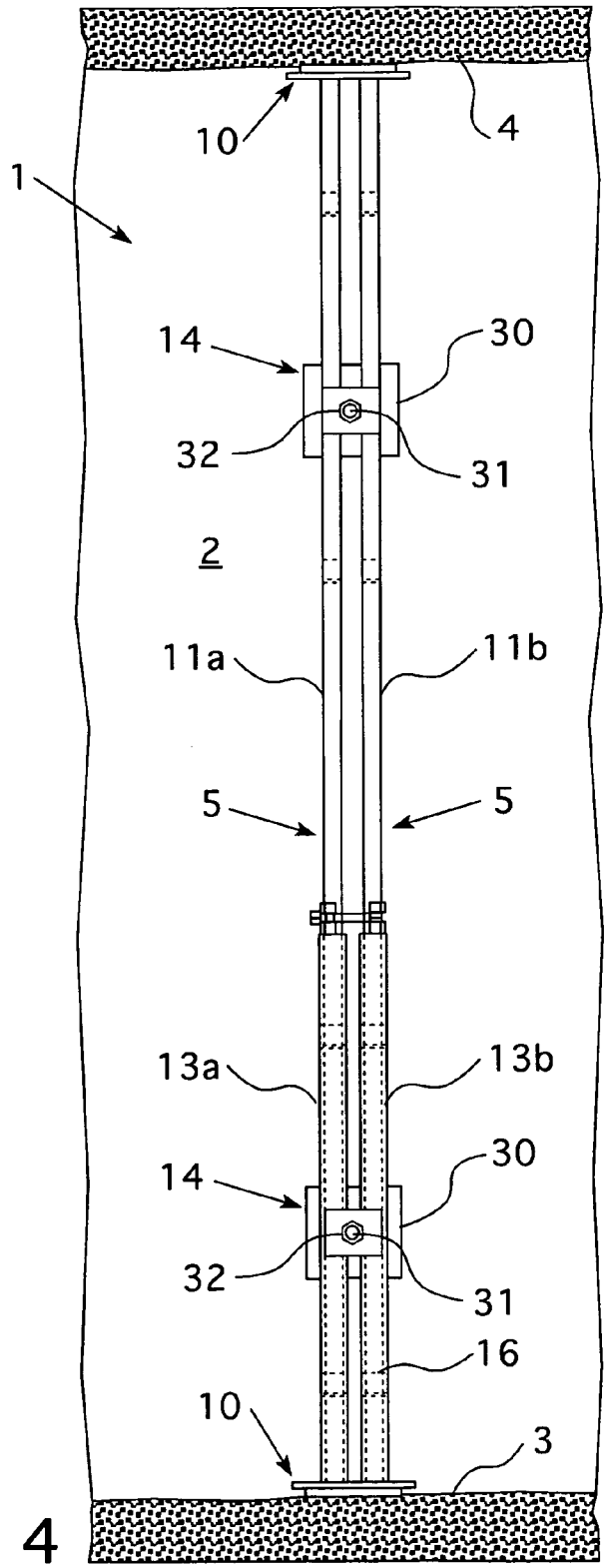
FIG. 4 is a left side view of the support member shown in FIG. 3.

Referring next to the embodiment of FIGS. 3 and 4, the support member 5 is in all respects identical to that of FIGS. 1 and 2, with the exception that the support member 5 is constructed of two continuous and telescopically expandable support members which are arranged adjacent to each other in parallel, and two (upper and lower) laterally extending mine rib support members 14 are provided instead of one. The mine rib support member 5 of FIGS. 3 and 4 is erected in the same manner as the support member shown in FIGS. 1 and 2 and the laterally mine rib supports 14 are extended laterally in the same manner to engage the mine rib 2 under compression in order to prestress dual support member 14.

In this embodiment, upper member 11 of FIG. 1 is substituted with the two upper members 11*a* and 11*b*, and lower member 13 is substituted with lower members 13*a* and 13*b*.

The two laterally extendable mine rib supports 14 may be not only adjusted laterally to engage the mine rib 2 under compression, but in addition, they may also be adjusted vertically to clamp along the dual support members 5 to more easily adjust the support member to the contours of the surface of mine rib 2.

Figure 5:
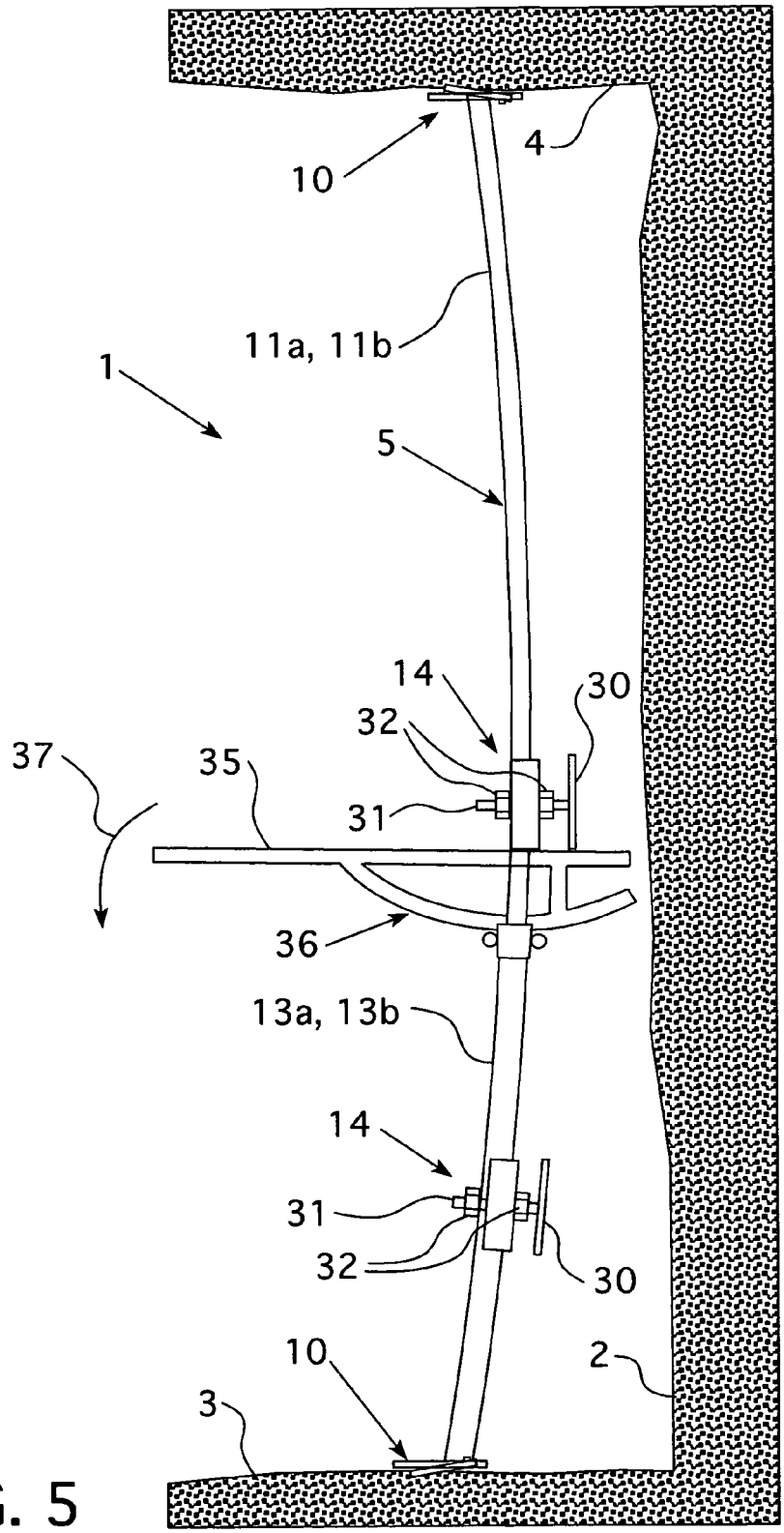
FIG. 5 is a view in side elevation of the support member shown in FIGS. 3 and 4 with the inclusion of a tensioning tool for partially placing the support member in a prestressed condition prior to laterally extending the two rib engagement plates for engagement under compression with the mine rib.

Referring next to FIG. 5, the support member 5 illustrated is in all respects identical to that illustrated in FIG. 3, except for the fact that the upper laterally extending mine rib support member 14 is moved to a lower vertical position as illustrated in the figure to engage the upper side of tensioning tool 35. The bottom side of tensioning tool 35 provides a curved tensioning surface 36 which engages clamp 15. When positioned in this manner, tensioning tool 35 may be pushed downwardly as indicated by arrow 37 whereby tensioning tool 35 applies leverage against the bottom of the upper laterally extensible mine rib engagement member 14 to telescopically expand support member 5 until it is under sufficient compression to place the support member 5 into a prestressed condition. At this point clamp 15 is then engaged to maintain support member 5 in a prestressed condition. Thereafter, laterally extendable rib support members 14 are vertically adjusted to a desired position, there clamped and then laterally extended to engage the surface of mine rib 2 under compression to provide support for the mine rib 2. Accordingly, in this embodiment the desired prestressed condition of support member 5 is created by tensioning tool 35 prior to engagement of laterally extending mine rib supports 14, whereas in the previous embodiments, member 5 is placed under a prestressed condition by lateral extension and contact of mine rib support members 14 under compression with mine rib 2. However, in the embodiment shown in FIG. 5, additional prestress can be imparted to the support member 5 by extended engagement of plates 30 with mine rib 2 under compression.

Figure 6:
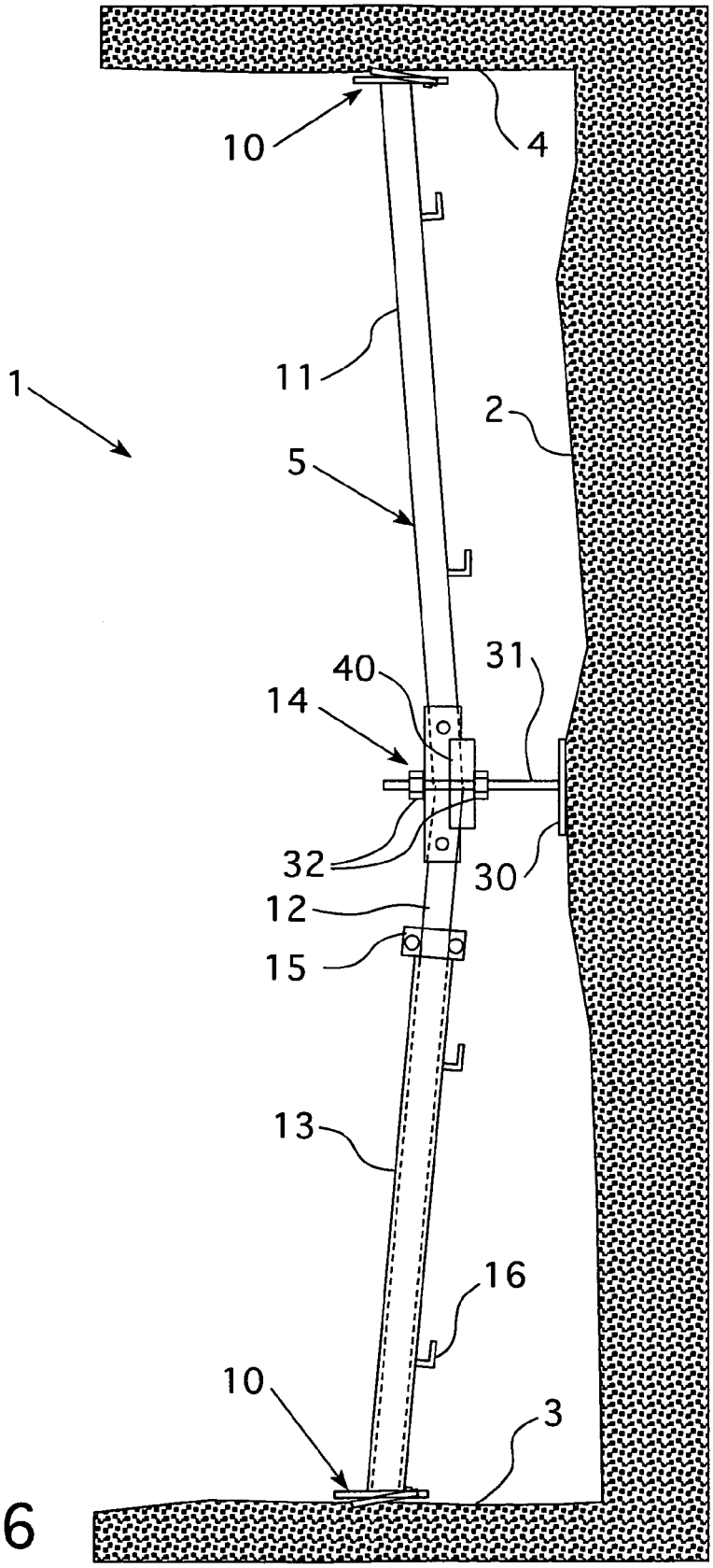
FIG. 6 is a view in side elevation of another embodiment of the mine rib support member of the present invention wherein the preset curvature thereof is provided, at least in part, by a hinged bent knee positioned intermediate its opposite ends.
Figure 7:
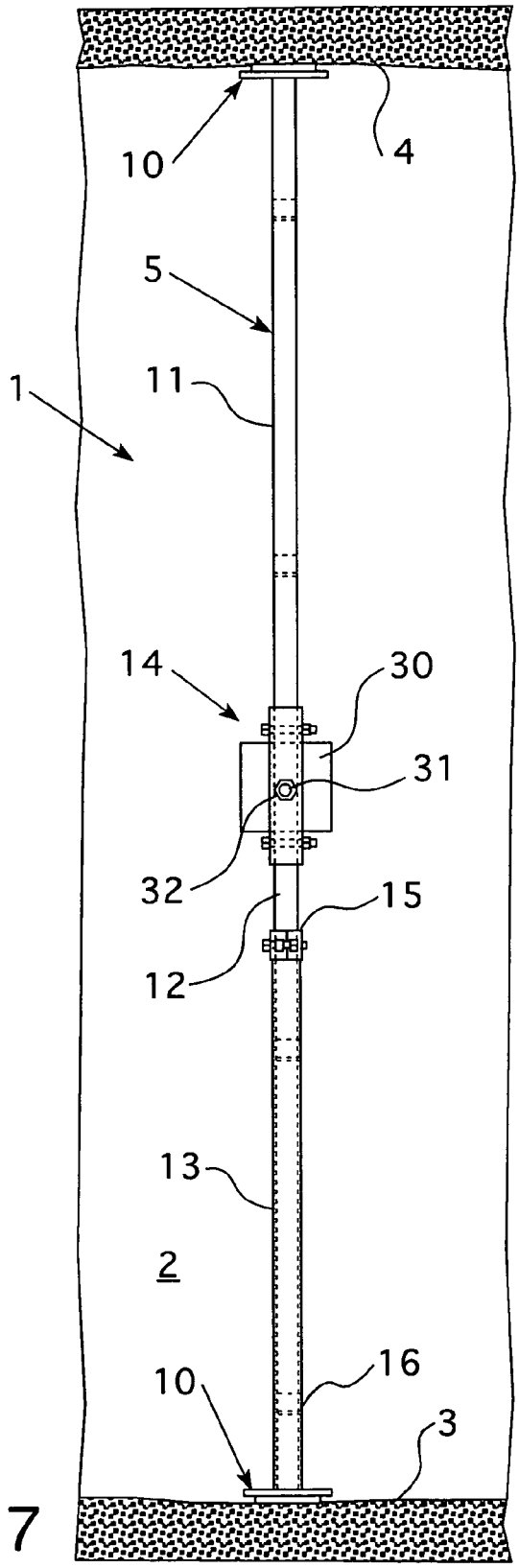
FIG. 7 is a left side view in elevation of the support member shown in FIG. 6.

Referring next to the embodiment illustrated in FIG. 6, the support member 5 in all respects is substantially identical in construction and operation to the embodiment illustrated in FIGS. 1 and 2. The only difference is that the preset curvature of the support member 5 illustrated in FIG. 6 is provided by the hinged bent knee 40 positioned intermediate its opposite ends 6 and 7. This provides the necessary preset curvature whereby the curvature of the member 5 may be positioned toward the mine rib 2 and the mine rib support member 14 is laterally extended into compression engagement, as before, with the mine rib 2 to place the support member 5 into a prestressed condition.

Figure 8:
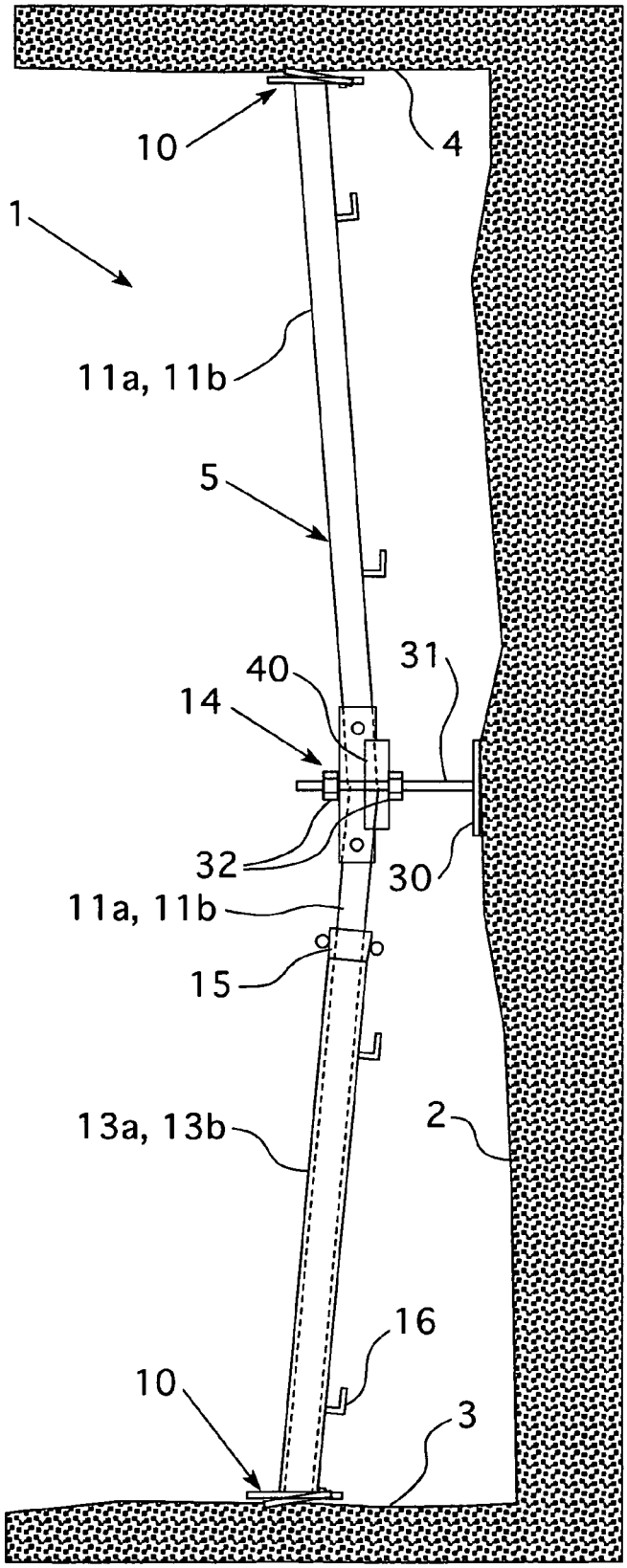
FIG. 8 is a view in side elevation of another embodiment of the support member illustrated in FIG. 6 which includes two adjacent parallel support members comprising the support member of the present invention.
Figure 9:
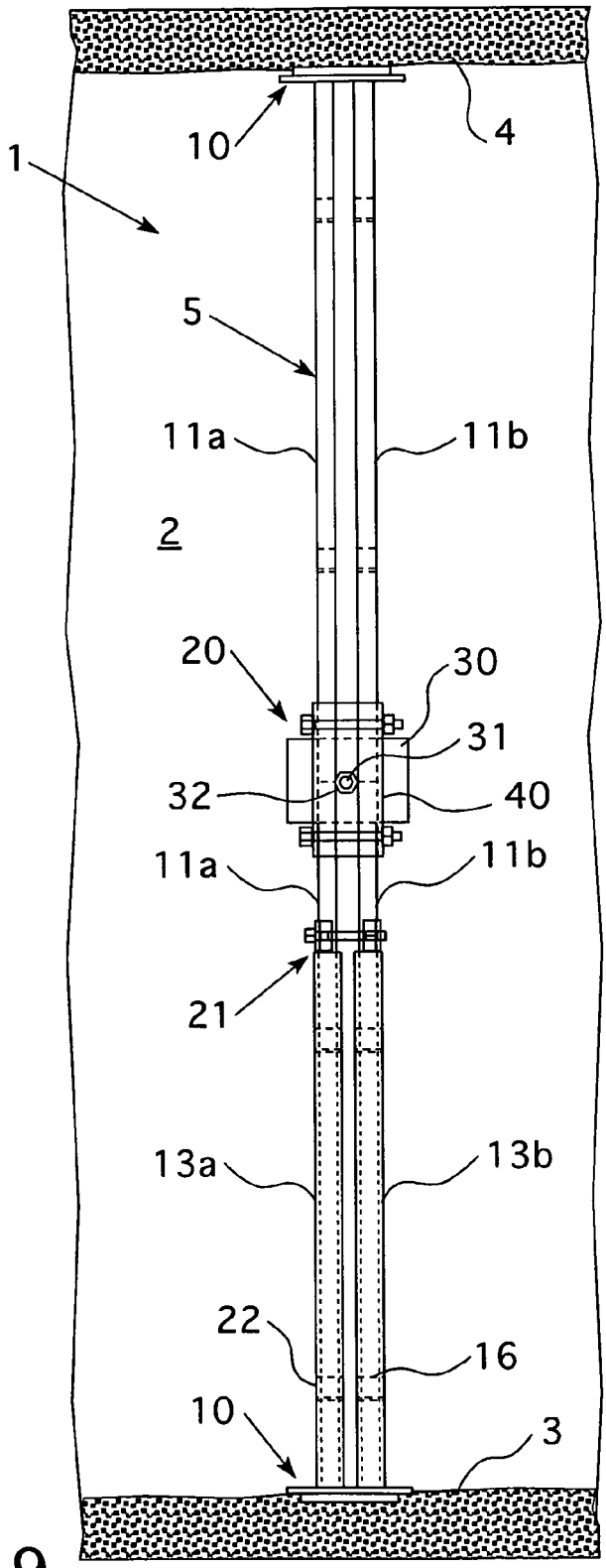
FIG. 9 is a left side view in elevation of the double support member shown in FIG. 8.

The embodiment illustrated in FIGS. 8 and 9 is in all respect identical to that illustrated in FIG. 6 with the exception that the embodiment of FIGS. 8 and 9 is similar to the embodiment illustrated in FIGS. 3 and 4 wherein the support member 5 is comprised of side-by-side spaced parallel support members 5 wherein the upper ends 11*a* and 11*b* are similarly constructed of steel tubing and the lower portions 13*a* and 13*b* telescopically receive bottom ends of upper members 11*a* and 11*b* respectively.

We claim:

1. A mine rib support for bracing a substantially vertical mine rib disposed between a mine floor and a mine roof, said support comprising:

an elongated upright, continuous and telescopically expandable support member having a preset curvature, and which is longitudinally expandable for engaging the mine floor and mine roof under compression with the curvature thereof protruding toward said mine rib;

means for longitudinally expanding and locking said support member into end engagement with said mine floor and roof; and at least one rib engagement plate secured to said support member for adjustable lateral extension to adjustably engage said rib under compression to thereby place said support member in a prestressed condition for supporting said mine rib.

2. The mine rib support of claim 1, wherein the preset curvature of said continuous support member is provided, at least in part, by a hinged bent knee positioned intermediate its opposite ends.

3. The mine rib support of claim 1, including transverse end plates secured to opposite ends of said support member for respective engagement with the mine floor and roof, said plates including outwardly hinged plate portions secured to said opposite ends whereby said hinged plates are biased for gouging into surfaces of the mine floor and roof when said support member is placed under prestress.

4. The mine rib support of claim 1, said support member including two adjacent parallel upright continuous and telescopically expandable members having preset curvature and secured together in spaced relationship.

5. The mine rib support of claim 1, including two of said rib engagement plates.

6. The mine rib support of claim 1, said continuous support member comprised of metal tubing.

7. A mine rib support for bracing a substantially vertical mine rib disposed between a mine floor and a mine roof, said support comprising;

an elongated upright support member having a preset curvature, and which is longitudinally expandable for engaging said mine floor and mine roof under compression with the curvature thereof protruding toward said mine rib;

means for longitudinally expanding and locking said support member into end engagement with said mine floor and roof and laterally engaging said support member with said mine rib under compression whereby said support member is prestressed to support said miner rib; and transverse plates secured to opposite ends of said support member for respective engagement with the mine floor and roof, said plates including outwardly hinged plate portions secured to said opposite ends whereby said hinged plates are biased for gouging into surfaces of the mine floor and roof when said support member is placed under prestress.

8. The method of bracing a substantially vertical mine rib disposed between a mine floor and a mine roof, comprising:

providing a curved and continuous telescopically expandable elongate support member and positioning said support member in an upright manner adjacent to said mine rib and telescopically expanding said support member to engage said mine floor and said mine roof under compression adjacent to said mine rib with the curvature of said support member protruding toward said mine rib; and laterally extending a support plate from said prestressed support member into compression engagement with said mine rib and thereby prestressing said support member for support of said mine rib.

* * * * *